US005119834A

United States Patent [19]

Shannon et al.

[11] Patent Number: 5,119,834

[45] Date of Patent: Jun. 9, 1992

[54] SMOKING ARTICLE WITH IMPROVED SUBSTRATE

[75] Inventors: Michael D. Shannon; Andrew J. Sensabaugh, Jr., both of Winston-Salem, N.C.

[73] Assignee: R. J. Reynolds Tobacco Company, Winston-Salem, N.C.

[21] Appl. No.: 723,399

[22] Filed: Apr. 15, 1985

[51] Int. Cl.[5] ..... A24D 1/00; A24D 1/18

[52] U.S. Cl. ..... 131/194; 131/335; 131/359

[58] Field of Search ..... 131/360, 359, 369, 194, 131/335, 361

[56] References Cited

U.S. PATENT DOCUMENTS

| | | | |
|---|---|---|---|
| Re. 27,214 | 11/1971 | Nakahara . | |
| 198,075 | 12/1877 | Brisbane . | |
| 1,529,181 | 3/1925 | Holmes . | |
| 2,178,820 | 11/1939 | Todoroff . | |
| 2,471,116 | 5/1949 | Newberger . | |
| 2,890,704 | 6/1959 | Lamm . | |
| 2,907,686 | 10/1959 | Siegel . | |
| 2,998,012 | 8/1961 | Lamm . | |
| 3,200,819 | 4/1963 | Gilbert . | |
| 3,220,418 | 11/1968 | Cohn . | |
| 3,258,015 | 6/1966 | Ellis . | |
| 3,356,094 | 12/1967 | Ellis . | |
| 3,516,417 | 6/1970 | Moses . | |
| 3,738,374 | 7/1973 | Bennett . | |
| 3,886,954 | 6/1975 | Hannema . | |
| 3,943,941 | 4/1975 | Boyd . | |
| 4,044,777 | 8/1977 | Boyd . | |
| 4,079,742 | 4/1978 | Ranier . | |
| 4,284,089 | 8/1981 | Ray . | |
| 4,286,604 | 9/1981 | Ehretsmann . | |
| 4,326,544 | 4/1982 | Hardwick . | |
| 4,340,072 | 7/1982 | Bolt et al. | 131/360 |
| 4,407,308 | 10/1983 | Baker . | |
| 4,481,958 | 11/1984 | Rainer . | |
| 4,553,556 | 11/1985 | Lephardt . | |

FOREIGN PATENT DOCUMENTS

| | | |
|---|---|---|
| 276250 | 7/1965 | Australia . |
| 0117355 | 9/1984 | European Pat. Off. . |
| 1294351 | 9/1977 | Fed. Rep. of Germany . |
| 370962 | 10/1906 | France . |
| 998556 | 10/1945 | France . |
| 1264962 | 8/1960 | France . |
| 2033749 | 11/1970 | France . |
| 2057421 | 4/1971 | France . |
| 2057422 | 4/1971 | France . |
| 35-9894 | 5/1960 | Japan . |
| 42-8684 | 1/1967 | Japan . |
| 956544 | 1/1963 | United Kingdom . |
| 1185887 | 3/1970 | United Kingdom . |
| 1431045 | 4/1972 | United Kingdom . |
| 1597106 | 9/1981 | United Kingdom . |

OTHER PUBLICATIONS

Materials submitted to the Senate Committee on Commerce by Mr. Herbert A. Gilbert in Sep. of 1967 (includes newspaper article).

(List continued on next page.)

*Primary Examiner*—V. Millin

*Attorney, Agent, or Firm*—Grover M. Myers; David G. Conlin

[57] ABSTRACT

The present invention is directed to a smoking article which produces an aerosol that resembles tobacco smoke but which preferably contains no more than a minimal amount of incomplete combustion or pyrolysis products. The preferred smoking article of the present invention provides an aerosol "smoke" which is chemically simple, consisting essentially of air, oxides of carbon, water, and the aerosol which carries any desired flavor or other desired volatile materials as well as trace amounts of other materials. In addition to a mouthend piece, an especially preferred embodiment of the present smoking article comprises a short combustible carbonaceous fuel element which is less than about 30 mm in length prior to smoking. The fuel element is disposed longitudinally relative to a physically separate aerosol generating means which comprises a porous nonparticulate substrate. The substrate includes one or more aerosol forming substances.

19 Claims, 2 Drawing Sheets

OTHER PUBLICATIONS

G. Hagg, General Inorganic Chemistry, at p. 592 (John Wiley & Sons, 1969).
Ames et al., Mut. Res. 31: 347-364 (1973).
Nago et al., Mut. Res. 42:335 (1977).
Guinness World Book of Records, pp. 242-243 (1985 Edition).
Guinness World Book of Records, p. 194 (1966 Edition).
M. L. Reynolds, "Influence of Filter Additives on Smoke Composition," Rec. Adv. Tob. Sci. 4:47 (1978).
L. L. Lyerly, "Direct Vapor Chromatographic Determination of—Triacetin in Cigarette Smoke," Tob. Sci. 50.26.(1967).
J. E. Kiefer et al., "Factors that Affect Elution of Plasticizer from Cigarette Filters," EK Pub. No. FTR—65 (1980).
Hach's Chem. Dictionary, 34, 4th ed. 1969.
Lange's Handbook of Chemistry, 10, 272-74 (11th ed. 1973).

SMOKING ARTICLE WITH IMPROVED SUBSTRATE

BACKGROUND OF THE INVENTION

The present invention relates to a smoking article which produces an aerosol that resembles tobacco smoke and preferably contains no more than a minimal amount of incomplete combustion or pyrolysis products.

Many smoking articles have been proposed through the years, especially over the last 20 to 30 years. Put none of these products has ever realized any commercial success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists cf these substitutes is found in U.S. Pat. No. 4,079,742 to Rainer et al. Despite these extensive efforts, it is believed that none of these products has been found to be completely satisfactory as a tobacco substitute.

Many proposed smoking articles have been based on the generation of an aerosol or a vapor. Some of these products purportedly produce an aerosol or a vapor without heat. See, e.g., U.S. Pat. 4,284,089 to Ray. However, the aerosols or vapors from these articles fail to adequately simulate tobacco smoke.

Some proposed aerosol generating smoking articles have used a heat source in order to produce an aerosol. However, none of these articles has ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2½ inch (63.5 mm) stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which had an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then removed when the smoker eliminated ash from the end of the article. Even though the appearance of the article was very similar to a conventional cigarette, apparently no commercial product was ever marketed.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British Patent 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3 butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter offtastes. Similar products were proposed in U.S. Pat. No, 4,286,604 to Ehretsmann et al. and in U.S. Pat. No. 4,326,544 to Hardwich et al.

Bolt et al., in U.S. Pat. No. 4,340,072 proposed a smoking article having a fuel rod with a central air passageway and a mouthend chamber containing an aerosol forming agent. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming agent was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of tobacco or tobacco substitute materials, which would provide substantial pyrolysis products and sidestream smoke which would not be desirable in this type of smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, lines, 17-35. This article would suffer many of the same problems as the articles proposed by Bolt et al.

Thus, despite decades of interest and effort, there is still no smoking article on the market which provides the benefits and advantages associated with conventional cigarette smoking, but without the presence of the substantial pyrolysis and incomplete combustion products present in cigarette smoke.

SUMMARY OF THE INVENTION

The present invention relates to a smoking article which is capable of producing substantial quantities of aerosol, both initially and over the useful life of the product, without significant thermal degradation of the aerosol former and without the presence of substantial pyrolysis or incomplete combustion products or sidestream smoke. Thus, the article of the present invention is able to provide the user with the sensations and benefits of cigarette smoking without burning tobacco These and other advantages are obtained by providing a smoking article which utilizes a combustible fuel element, preferably of a carbonaceous material, in conjunction with a physically separate means for generating an aerosol, comprising a porous substrate bearing an aerosol forming substance, in which the substrate has at least one longitudinal passageway, extending at least partially therethrough.

The fuel element and the aerosol generating means are arranged such that heat generated by the burning fuel element is conducted to the aerosol generating means both during puffing and during smolder. In addition, a heat conducting or insulating member, such as a metal foil or a jacket of insulating fibers, can be used to aid in the transfer of heat to the aerosol generating means by increasing conductive heat transfer or by reducing radial heat loss, respectively.

As used herein, and only for the purposes of this application, "aerosol" is defined to include vapors, gases, particles, and the like, both visible and invisible, and especially those components perceived by the user to be "smoke-like", generated by action of the heat from the burning fuel element upon substances contained within the aerosol generating means, or elsewhere in the article. As so defined, the term "aerosol" also includes volatile or sublimable flavoring agents and/or pharmacologically or physiologically active agents, irrespective of whether they produce a visible aerosol.

As used herein, the term "physically separate" means that the aerosol generating means is not mixed with, or a part of, the fuel element.

In a preferred aspect of the present invention, the smoking article has a short, combustible carbonaceous fuel element, generally less than about 30 mm long, which is substantially free of volatile organic material. Preferably, the fuel element is less than about 15 mm in length.

A physically separate aerosol generating means, comprising a nonparticulate, porous substrate containing an aerosol forming substance, is preferably located in a conductive heat exchange relationship to the fuel element. More preferably, this heat exchange relationship is achieved by providing a heat conductive member which efficiently conducts or transfers heat from the burning fuel element to the aerosol generating means. Advantageously, the aerosol generating means is a relatively short body, again generally less than about 30 mm long, which either abuts or is adjacent to the nonlighting end of the fuel element. Preferably, the aerosol generating means is a nonparticulate, porous substrate, having at least one longitudinally extending, defined passageway, and is impregnated with one or more aerosol forming substances. As used herein, the term "defined passageway" means that the passageway thus described is a continuous, uninterrupted, longitudinal passageway. That is, there are no significant or substantial obstructions in the passageway which may have a uniform size throughout or may have one or more tapered ends or have other suitable shapes. Alternate nonobstructed passageways may be designed by the skilled artisan.

Surprisingly, it has been discovered that the presence of a longitudinal, defined passageway extending through the substrate aids greatly the aerosol forming properties of the present smoking article. While not wishing to be bound by theory, it is believed that the passageway provides an internal surface which upon heating warms the aerosol former such that it wicks or exudes to the surface. This provides a replenishable supply of aerosol former for aerosol generation. It is believed that this wicking action delivers substantially more aerosol forming material to the hottest portion of the substrate and thus, delivers more aerosol than similar articles not having such a defined passageway. In addition, heat is directed to the area where the aerosol former is vaporized rather than being utilized for heating the mass of the substrate.

The smoking article of the present invention normally is provided with a mouthend piece including means, such as a longitudinal passage, for delivering the aerosol produced by the aerosol generating means to the user. Advantageously, the article has the same overall dimensions as a conventional cigarette, and as a result, the mouthend piece and the aerosol delivery means usually extend over more than one-half the length of the article. Alternatively, the fuel element and the aerosol generating means may be produced without a built-in mouthend piece or aerosol delivery means, for use with a separate, disposable or reusable mouthpiece.

The smoking article of the present invention also may include a charge of tobacco which is used to add a tobacco flavor to the aerosol. Preferably, the tobacco is placed at the mouthend of the aerosol generating means. Flavoring agents also may be incorporated into the tobacco, or elsewhere in the delivery means to flavor the aerosol delivered to the user.

Preferred embodiments of the invention are capable of delivering at least 0.6 mg of aerosol, measured as wet total particulate matter (WTPM), in the first 3 puffs, when smoked under FTC standard smoking conditions, which consist of a 35 ml puff of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first three puffs when smoked under FTC standard smoking conditions. Moreover, preferred embodiments of the invention deliver an average of at least about 0.8 mg of wet total particulate matter per puff under FTC standard smoking conditions.

In addition to the aforementioned benefits, the smoking article of the present invention provides an aerosol which is chemically simple, consisting essentially of air, oxides of carbon, water, and the aerosol which carries any desired flavors or other desired volatile materials, and trace amounts of other materials. The aerosol has no significant mutagenic activity using the Ames Test discussed infrra. In addition, the article may be made virtually ashless so that the user does not have to remove any ash during use.

The smoking article of the present invention is described in greater detail in the accompanying drawings and in the detailed description of the invention which follows.

DETAILED DESCRIPTION OF THE PREFERRED EMBODIMENTS

Figure 1:
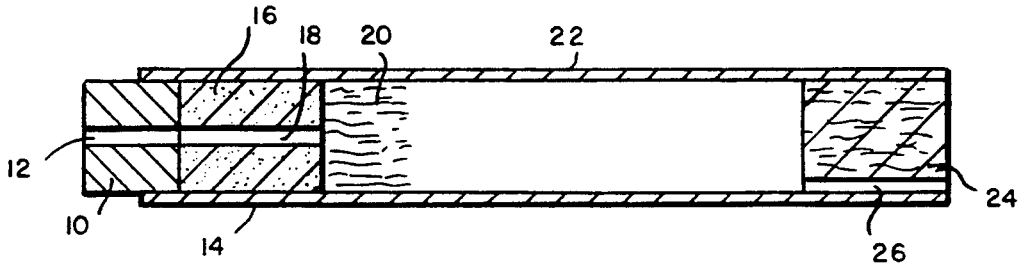
FIGS. 1 through 3 are longitudinal sectional views of various embodiments of the invention.
Figure 1A:
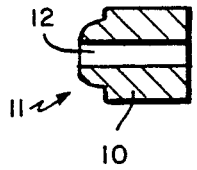
FIGS. 1A is a sectional view of the embodiment of FIG. 1, taken along lines 1A—1A in FIG. 1.

The embodiment of the invention illustrated in FIG. 1, which has about the same diameter as a conventional cigarette comprises a short fuel element 10 which is a pressed carbon rod about 20 mm long, and which is provided with a longitudinal passageway 12. Alternatively, the fuel may be formed from carbonized fibers, preferably provided with a longitudinal passageway corresponding to the passageway 12. In this embodiment, aerosol generating means 14 includes a thermally stable, heat conductive, carbonaceous, nonparticulate, porous, substrate 16, such as a plug of porous carbon, which is impregnated with one or more aerosol forming substances. This substrate is provided with a longitudinal, passageway 18, which, as illustrated may be aligned with the fuel element passageway 12. This embodiment also includes a mass of tobacco 20 which is preferably placed at the mouth end of substrate 16. For appearance sake, this article also includes an optional high porosity cellulose acetate filter 24, which may be provided with peripheral grooves 26 to provide passages for the aerosol between filter 24 and the foil lined tube mouthend piece 22. Optionally, as shown in FIG. 1A, the lighting end 11 of the fuel element may be tapered to improve lightability.

Figure 2:
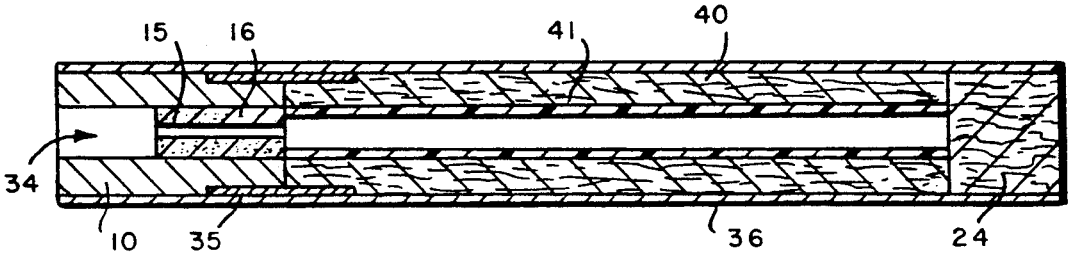

The embodiment illustrated in FIG. 2 illustrates the use of a nonparticulate, porous, substrate 16 embedded within a large cavity 34 in fuel element 10. In this embodiment, the fuel element preferably is formed from an extruded carbon, and the substrate 16 usually is a relatively rigid, material. The longitudinal passageway 18 in the substrate was formed by conventional drilling of the substrate material. The mouthend piece of this embodiment consists of a cellulose acetate tube 40, including an annular section of cellulose acetate tow 42, surrounding an optional plastic, e.g., polypropylene or mylar tube 44. At mouth end of this embodiment, there is a low efficiency cellulose acetate filter 24. The entire length of the article is wrapped with conventional cigarette paper 36. This embodiment may also include a foil strip 35 to couple fuel element 10 to the cellulose acetate tube mouthend piece 40 and to help extinguish the fuel.

Figure 3:
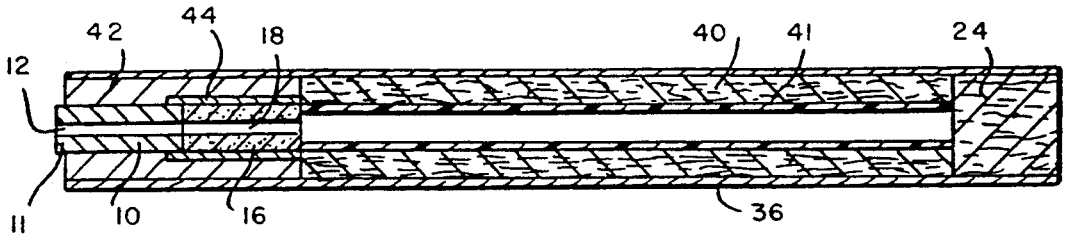
Figures 3A, 3B, 3C, 3D:
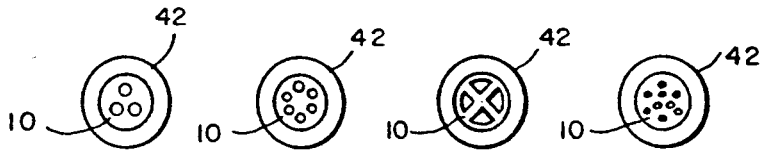
FIGS. 3A-3D illustrate various fuel element passageway configurations, showing approximate size and location.

In the embodiment shown in FIG. 3, both fuel element 10 and nonparticulate, porous, substrate 16 are located within an annular jacket or tube 42 of ceramic fibers, such as fiberglass. Nonburning carbon or graphite fibers may be used in place of ceramic fibers. Fuel element 10 is preferably an extruded carbon plug having a passageway 12. Several alternative fuel element passageway configurations are illustrated in FIGS. 3A-3D. In the illustrated embodiment, the lighting end 11 extends slightly beyond the edge of jacket 42 for ease of lighting. Substrate 16 is a solid porous carbon material through which passageway 18 extends, although other types of nonparticulate, porous substrates may be used. Preferably, as illustrated, passageway 12 through the fuel element, and passageway 18, through the substrate, are aligned, but other, i.e., non-aligned configurations are within the scope of the present invention. The nonparticulate, porous substrate and the rear portion of the fuel element are surrounded by a piece of aluminum foil 44. As illustrated, this jacketed fuel substrate unit is coupled to a mouthend piece, such as the elongated cellulose acetate tube 40 shown in the drawing, with an overwrap of conventional cigarette paper 36. The jacket 42 extends to the mouth end of substrate 16.

Upon lighting, the fuel element generates heat which is used to volatilize the aerosol forming substance or substances contained in the nonparticulate, porous substrate. These volatile materials are then drawn toward the mouthend, especially during puffing, and into the user's mouth, akin to the smoke of a conventional cigarette. Because the fuel element preferably is relatively short, the hot, burning fire cone is always close to the aerosol generating body, which maximizes heat transfer to the aerosol generating means and the resultant production of aerosol.

The preferred use of a relatively short, low mass aerosol generating body, in close proximity to the short fuel element, also increases aerosol production by minimizing the heat sink effect of the nonparticulate, porous substrate. Because the aerosol forming substance is physically separate from the fuel element, it is exposed to substantially lower temperatures than are present in the burning fire cone, which minimizes the possibility of thermal degradation of the aerosol former. Moreover, the preferred use of a carbonaceous fuel element which is substantially free of volatile organic material eliminates the presence of substantial pyrolysis or incomplete combustion products and the presence of substantial sidestream smoke.

In another important aspect of the present invention, the smoking article is provided with means for conducting heat from the fuel element to the aerosol generating means. Preferably, the heat conducting means is a heat conducting member, such as a metal foil which advantageously contacts both the fuel element and the aerosol generating means. Contact of the metal foil is preferably along the external longitudinal surfaces of the fuel element and the aerosol generator, unless the substrate is located within a cavity in the fuel element. In that case contact is preferably along the internal longitudinal surface of the fuel element and the external longitudinal surface of the substrate.

In preferred embodiments, the presence of a longitudinally extending passageway through the substrate substantially increases heat transfer to the aerosol generator which, in turn, volatilizes larger quantities of the aerosol former for delivery to the user. This increased heat transfer is, in part, due to the fact that the passageway aids in heat transfer both during puffing and during smolder. This increased heat transfer makes more efficient use of the available fuel energy, reduces the amount of fuel needed, helps deliver aerosol on the initial puffs, and substantially reduces material costs of the fuel.

In a particularly preferred embodiment of the invention, the fuel element is a pressed carbon plug or mass of carbonized fibers, generally about 10 mm or less in length, which is provided with at least one longitudinal passage, such as shown in FIGS. 1-3, to aid heat transfer to the aerosol generator. The aerosol generating means comprises a thermally stable, preferably carbonaceous, nonparticulate, porous substrate about 10 mm or less in length which is impregnated with one or more aerosol forming substances, such as glycerol or a mixture of glycerol and propylene glycol. This substrate is preferably provided with one or more longitudinal passageways which may be aligned with at least one of the longitudinal passageway(s) in the fuel element. The fuel element and substrate are preferably joined by heat conductive metal foil, e.g., aluminum, which envelops the longitudinal periphery of the nonlighting end of the fuel element and at least a portion, and preferably all, of the longitudinal periphery of the nonparticulate, porous substrate.

If a charge of tobacco is employed, hot vapors are swept through the bed of tobacco to extract and vaporize the volatile components in the tobacco, without the need for tobacco combustion or pyrolysis. Thus the user of this smoking article receives an aerosol which contains the qualities and flavors of natural tobacco without the combustion products produced by a conventional cigarette.

In general, the combustible fuel elements which may be employed in practicing the have, the diameter of a conventional cigarette, and are generally less than about 30 mm long. Advantageously the fuel element is about 20 mm or less in length, preferably about 15 mm or less in length. Advantageously, the diameter of the fuel element is between about 3 to 8 mm, 4 to 5 mm.

The preferred fuel elements employed herein are primarily formed of a carbonaceous material. Preferably, the carbon content of these fuel elements is at least 80%, most preferably about 90% or more, by weight. High carbon content fuel elements are preferred because they produce minimal pyrolysis and incomplete combustion products, little or no visible sidestream smoke, minimal ash, and high heat capacity. However, lower carbon content fuel elements, e.g., 60% by weight, are within the scope of this invention, especially where a nonburning inert filler is used. Also, while not preferred, other fuel elements may be employed, such as tobacco substitutes and the like.

The carbonaceous materials used in or as the preferred fuel element may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

Carbonaceous fuel elements are preferably less than 30 mm in length, more preferably less than 20 mm in length, and most preferably from about 3 to 10 mm in length. The density of the carbonaceous fuel element employed herein has ranged from about 0.5 g/cc to about 1.5 g/cc. Preferably, the density is greater than 0.7 g/cc. Carbonaceous fuel elements having these characteristics are sufficient to provide fuel for at least about 7 to 10 puffs, the normal number of puffs generally obtained by smoking a conventional cigarette under FTC conditions.

In most instances, the carbonaceous fuel elements should be capable of being ignited by a conventional cigarette lighter without the use of an oxidizing agent. Burning characteristics of this type may generally be obtained from a cellulosic material which has been pyrolyzed at temperatures between about 400° to about 1000° C., preferably between about 500° C. to about 950° C., in an inert atmosphere or under a vacuum. The pyrolysis time is not believed to be critical, as long as the temperature at the center of the pyrolyzed mass has reached the aforesaid temperature range for at least a few minutes. However, a slow pyrolysis, employing gradually increasing temperatures over several hours is believed to produce a more uniform material with a higher carbon yield.

Because of the small size and burning characteristics of the carbonaceous fuel elements preferably employed in the present invention, the fuel element usually begins burning over substantially all of its exposed length within a few puffs. Thus, the portion of the fuel element adjacent to the aerosol generator becomes hot quickly, which significantly increases heat transfer to the aerosol generator, especially during the early and middle puffs. Because the preferred fuel element is so short, there is never a long section of nonburning fuel to act as a heat sink, as in previous thermal aerosol articles. Heat transfer, and therefore aerosol delivery, is especially enhanced by the use of passageways through the fuel and the substrate, which pass hot gases through the aerosol generator, especially during puffing.

While undesirable in most cases, carbonaceous fuel elements which require the addition of an oxidizing agent to render them ignitable by a cigarette lighter are within the scope of this invention, as are carbonaceous fuel elements which require the use of a glow retardant or other type of combustion modifying agent. Such combustion modifying agents are disclosed in many prior art patents and publications and are known to those of ordinary skill in the art.

The carbonaceous fuel elements most preferably used in practicing the invention are substantially free of volatile material. By that, it is meant that the fuel element is not purposely impregnated or mixed with substantial amounts of volatile materials, such as volatile aerosol forming or flavoring agents, which could degrade at the combustion temperatures of the fuel. However, small amounts of water, which are naturally adsorbed by the fuel, may be present in the fuel. While undesirable, small amounts of aerosol forming substance may migrate from the aerosol generator and thus may also be present in the fuel.

A preferred carbonaceous fuel element is a pressed or extruded carbon mass prepared from carbon and a binder, by conventional pressure forming or extrusion techniques. A preferred activated carbon for such a fuel element is PCB-G, and a preferred non-activated carbon is PXC, both available from Calgon Carbon Corporation, Pittsburgh, Pa. Other preferred carbons are prepared from pyrolyzed cotton or pyrolized papers, such as Grande Prairie Canadian Kraft, available from Buckeye Cellulose Corp., Memphis, Tenn.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel.

In general, the pressed carbon fuel is prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste. The paste is homogenized by mixing and then dried to reduce the moisture content to about 5 to 10 weight percent. The dried paste is then ground, preferably in a Trost Mill, to a particle size of less than about 20 mesh. This ground material is treated with water to raise the moisture level to about 30 weight percent, and the moist solid is fed to forming means, such as a conventional pill press, wherein a die punch pressure of from about 1,000 pounds (455 kg) to about 10,000 pounds (4550 kg), preferably about 5,000 pounds (2273 kg), of load is applied to create a pressed pellet having the desired dimensions The pressed pellet is then dried at from about 550° C. to about 100° C. to reduce the moisture content to between 5 to 10 weight percent. A longitudinal passageway may be drilled using conventional techniques, or be formed at the time of pressing.

Alternatively, the forming means used may be a standard extruder. In that case, in addition to the ingredients described suprs, the amount of water used is just sufficient to obtain a stiff dough consistency. The dough is then extruded into the desired shape and dried. A longitudinal passageway, if desired, may be formed during the extrusion or drilled into the dried material.

If desired, the aforesaid fuel elements may be pyrolyzed after formation, for example, to about 650° C. for two hours, to convert the binder to carbon and thereby form a virtually 100% carbon fuel element.

The fuel elements also may contain one or more additives to improve burning, such as up to about 5 weight percent sodium chloride to improve smoldering characteristics and as a glow retardant. Also, up to about 5 preferably about 1 to 2, weight percent of potassium carbonate may be included to control flammability. Additives to improve physical characteristics, such as clays like kaolins, serpentines, attapulgites, and the like also may be used.

Another preferred carbonaceous fuel element is a carbon fiber fuel, which may be prepared by carbonizing a fibrous precursor, such as cotton, rayon, paper, polyacrylontrile, and the like. Generally, pyrolysis at from about 650° C. to 1000° C., preferably at about 950° C., for about 30 minutes, in an inert atmosphere or vacuum, is sufficient to produce a suitable carbon fiber with good burning characteristics. Combustion modifying additives also may be added to these preferred fuels.

The aerosol generating means used in practicing the invention is physically separate from the fuel element. By physically separate it is meant that the nonparticulate, porous, substrate which contains the aerosol forming materials is not mixed with, or a part of, the fuel. As noted previously, this arrangement helps reduce or eliminate thermal degradation of the aerosol forming substance and the presence of sidestream smoke. More importantly, the substrate is provided with at least one defined longitudinal passageway which provides an internal surface for the aerosol former to be vaporized. Less heat is required to volatilize the aerosol former from the passageway as less heat is lost to heating the mass of the substrate.

While not a part of the fuel, the aerosol generator preferably is in a conductive heat exchange relationship with the fuel element. As used herein, a conductive heat exchange relationship is defined as a physical arrangement of the nonparticulate, porous, substrate and the fuel element whereby conductive heat transfer from the burning fuel element takes place substantially throughout the burning period of the fuel element. Preferably, the heat exchange relationship is achieved by providing a heat conductive member, such as a metal foil, which efficiently conducts or transfers heat from the burning fuel element to the aerosol generating means. A metal foil preferably used in this article is aluminum foil of from 0.35 to 10 mils (0.0089 to 0.25 mm) thickness, but the thickness and/or the type of metal employed may be varied to achieve any desired degree of heat transfer. Other types of heat conducting members such as Grafoil, available from Union Carbide, also may be employed. Further, it is believed that conductive heat transfer reduces the carbon fuel combustion temperature and thus greatly reduces the $CO/CO_2$ ratio. See, e.g., C. Hagg, *General Organic Chemistry*, at p. 592 (John Wiley & Sons, 1969).

In many preferred embodiments, the aerosol generator merely abuts or is adjacent to the fuel element so that the fuel and the aerosol generator are in a heat exchange relationship substantially throughout the burning of the fuel element.

Preferably, the aerosol generating means includes one or more thermally stable materials which carry one or more aerosol forming substances. As used herein, a thermally stable material is one capable of withstanding the high temperatures, e.g., 400° C.-600° C., which exist near the fuel without the decomposition or burning. The use of such material is believed to help maintain the simple "smoke" chemistry of the aerosol, as evidenced by the lack of Ames Test activity which is described in greater detail infra.

Thermally stable materials which may be used as the nonparticulate, porous, substrate for the aerosol forming substance are well known to those skilled in the art. Useful substrates must be capable of retaining an aerosol forming compound and releasing a potential aerosol forming vapor upon heating by the fuel.

Useful thermally stable materials include thermally stable adsorbent carbons, such as electrode grade carbons, graphite, activated, or non-activated carbons, and the like in suitable form. Other suitable materials include inorganic solids such as ceramics, alumina, vermiculite, clays such as bentonite, and the like. The currently preferred substrate materials are activated carbons, and porous carbons such as PC-25 and PC-60 available from Union Carbide, as well as SGL carbon, available from Calgon.

Advantageous substrates may also be formed from carbon, tobacco or mixtures thereof, into composite particles using a machine made by Fuji Paudal KK (formerly Fuji Denki Kogyo KK) of Japan, and sold by the Luwa Corporation of Charlotte, N.C. under the trade name of "Marumerizer." This apparatus is described in German Patent No. 294,351 and U.S. Pat. No. 3,277,520 (now reissued as No. 27,214) as well as Japanese published specification No. 8684/1967. Nonparticulate substrates can be formed from thusly treated materials by conventional pressing, extrusion, cutting, shaping and similar techniques.

The substrate used in the invention is usually spaced no more than about 30 mm, preferably no more than 20 mm from the lighting end of the article. The substrate is usually between about 5 to 20 mm in length. The preferred length is between about 10 to 15 mm. The diameter of the substrate is generally the same as that of the fuel element. The diameter and/or number of passageways in the substrate may be varied depending upon the composition and physical properties of the substrate. Appropriate selection of the passageway configuration allows for control of the pressure drop and/or the amount of aerosol delivery.

The aerosol forming substance or substances used in the invention must be capable of forming an aerosol at the temperatures present in the aerosol generating means when heated by the burning fuel element. Such substances preferably will be composed of carbon, hydrogen and oxygen, but they may include other materials. The boiling point of the substance and/or the mixture of substances can range up to about 500° C. Substances having these characteristics include polyhydric alcohols, such as glycerin and propylene glycol, as well as aliphatic esters of mono-, di-, or poly-carboxylic acids, such as methyl stearate, dimethyl dodecandioate, dimethyl tetradecandioate, and others.

The aerosol forming substances may include a mixture of a high boiling, low vapor pressure substance and a low boiling, high vapor pressure substance. It is believed, on early puffs, the low boiling substance will provide most of the initial aerosol, while, when the temperature in the aerosol generator increases, the high boiling substance will provide most of the aerosol.

The preferred aerosol forming substances are polyhydric alcohols, or mixtures of polyhydric alcohols. A more preferred aerosol former is glycerin or a mixture of glycerin and propylene glycol, which substances are present in a weight ratio of from about 10:1 to 1:10, preferably 4:1 to 1:4.

The aerosol forming substance may be dispersed on or within the substrate, in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the nonparticulate, porous substrate material and distributed evenly throughout prior to formation of the final final block-like shape and prior to formation of the longitudinal passageway.

While the loading of the aerosol forming substance will vary from carrier to carrier and from aerosol forming substance to aerosol forming substance, the amount of liquid aerosol forming substances may generally vary from about 20 mg to about 120 mg, preferably from about 35 mg to about 85 mg, and most preferably from about 45 mg to about 65 mg. As much as possible of the aerosol former carried on the nonparticulate, porous, substrate should be delivered to the user as WTPM. Preferably, above about 2 weight percent, more preferably above about 15 weight percent, and most preferably above about 20 weight percent of the aerosol former carried on the nonparticulate, porous, substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generator and the mouthend, such as in a separate particulate or nonparticulate, substrate in the passage which connects the aerosol generator to the mouth end of the article or in the optional tobacco charge. If desired, these volatile agents may be used in lieu of part or all of the aerosol forming substance, so that the article delivers a flavor or other material to the user.

Articles of the type disclosed herein may be used or may be modified for use as drug delivery articles, for delivery of volatile pharmacologically or physiologically active materials such as ephedrine, metaproterenol, terbutaline or the like.

In most embodiments of the invention, the fuel and aerosol generator will be attached to a mouthend piece, although a mouthend piece may be provided separately, e.g., in the form of a cigarette holder. This element of the article provides the enclosure which channels the vaporized aerosol forming substance into the mouth of the user. Due to its length, preferably about 50 to 60 mm or more, it also keeps the hot fire cone away from the mouth and fingers of the user.

Suitable mouthend pieces should be inert with respect to the aerosol forming substances, should have a water or liquid proof inner layer, should offer minimum aerosol loss by condensation or filtration, and should be capable of withstanding the temperature at the interface with the other elements of the article. Preferred mouthend pieces include the foil lined tube of FIG. 1, the cellulose acetate tube employed in the embodiments of FIGS. 2 and 3, and a closed cellular, foamed tube. Other suitable mouthpieces will be apparent to those of ordinary skill in the art.

The mouthend pieces of the invention may include an optional "filter" tip, which is used to give the article the appearance of the conventional filtered cigarette. Such filters include low density cellulose acetate filters and hollow or baffled plastic filters, such as those made of polypropylene. In addition, the entire length of article or any portion thereof may be overwrapped with cigarette paper. Preferred papers should not openly flame during burning of the fuel element, should produce a grey, cigarette-like ash, and when a jacket of insulating fibers is employed, should have sufficient porosity to provide peripheral air flow through the fibers to support combustion of the fuel element during smolder. One such porous paper is ECUSTA 01788, produced by Ecusta of Pisgah Forest, N.C.

The insulating means which may be used in practicing this invention may be selected from any materials which act primarily as insulators. Preferably, these materials do not burn during use, but they may include slow burning carbons and like materials, as well as materials which fuse during use, such as low temperature grades of glass fibers. Such materials generally include inorganic fibers such as those made out of glass, alumina, silica, vitreous materials, carbons, silicons, boron, and the like, including mixtures of these materials. Several commercially available insulating fibers are prepared with a binder e.g., PVA, which acts to maintain structural integrity during handling. These binders should be remove, e.g., by heating in air at about 650 deg. C for up to about 15 min. before use herein.

The currently preferred insulating fibers are ceramic fibers, such as glass fibers. Two especially preferred glass fibers are available from the Manning Paper Company of Troy, N.Y., under the designations, Manniglas 1000 and Manniglas 1200. Generally the insulating fiber is wrapped over at least a portion of the fuel element and any other desired portion of the article, to a final diameter of from about 7 to 8 mm. Thus, the preferred thickness of the insulating layer is from about 0.5 mm to 2.5 mm, preferably, from about 1 mm to 2 mm. When possible, glass fiber materials having a low softening point, e.g., below about 650° C., are preferred.

The aerosol produced by the preferred articles of the present invention is chemically simple, consisting essentially of air, oxides of carbon, the aerosol which carries any desired flavor or other desired volatile materials, water, and trace amounts of other materials. The WTPM produced by the preferred articles of this invention has no mutagenic activity as measured by the Ames Test, i.e., there is no significant dose response relationship between the WTPM of the present invention and the number of revertants occurring in standard test microorganisms exposed to such products. According to the proponents of the Ames test, a significant dose dependent response indicates the presence of mutagenic materials in the products tested. See Ames et al., Mut. Res., 31:347-364 (1975); Nagao et al., Mut. Res., 42:335 (1977).

A further benefit from the preferred embodiments of the present invention is the relative lack of ash produced during use in comparison to ash from a conventional cigarette. As the preferred carbon fuel source is burned, it is essentially converted to oxides of carbon, with relatively little ash generation, and thus there is no need to dispose of ashes while using the article.

The smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the articles have a diameter of about 7 to 8 mm, the diameter of a conventional cigarette.

EXAMPLE 1

Four smoking articles were constructed as shown in FIG. 1 with a 10 mm pressed carbon fuel element having the tapered lighting end illustrated in FIG. 1A. The fuel element was made from 90% PCB-G carbon and 10% SCMC, at about 5000 pounds (2273 kg) of applied load. A 0.040 in. (1.02 mm) passageway was drilled down the center of the element. The nonparticulate, porous substrate for the aerosol former was cut and machined to shape from PC-25, a porous carbon sold by Union Carbide Corporation, Danbury, Conn. The substrate in each article was about 2.5 mm long, and about 8 mm in diameter. A passageway similar to that drilled through the fuel element was drilled through the substrate. The substrate was loaded with an average of about 27 mg of a 1:1 propylene glycol-glycerol mixture. The foil lined tube mouthend piece about 70 mm in length, consisted of a 0.35 mil. (0.0089 mm) layer of aluminum foil inside a 4.25 mil. (0.018 mm) layer of white spirally wound paper. This tube surrounded the rear 5 mm of the fuel element enclosed the rear 2 mm of the fuel element and the substrate. A plug of Burley tobacco, about 100 mg was placed against the mouthend of the nonparticulate, porous substrate. A short, about 5-9 mm, baffled polypropylene filterpiece was placed at the mouth end of the foil lined tube. A 32 mm length of a cellulose acetate filter with a hollow polypropylene tube in the core was placed between the tobacco and the filter piece. The overall length of each article was about 78 mm.

EXAMPLE 2

Six additional articles were constructed subsantially as in Example 1, but the substrate length 30 was increased to 5 mm. A 0.040 in (1.02 mm) passageway was drilled through the substrate. In addition, these articles did not have a cellulose acetate/polypropylene tube. About 42 mg of the propylene glycol-glycerol mixture was applied to the nonparticulate, porous substrate. In addition, two plugs of Burley tobacco, about 100-150 mg each, were used. The first was placed against the mouthend of the nonparticulate, porous substrate, and the second one was placed against the filter piece.

EXAMPLE 3

Four additional articles were constructed substantially as in Example 1, except that an approximately 100 mg plug of Flue-cured tobacco containing about six percent by weight of diammonium monohydrogen phosphate was used in lieu of the plug of Burley tobacco.

EXAMPLE 4

A smoking article was built with a 10 mm pressed carbon fuel plug having the configuration shown in FIG. 1A, but with no tobacco. The fuel element was made from a mixture of 90% PCB-G activated carbon and 10% SCMC as a binder at about 5000 pounds (2273 kg) of applied load. The fuel element was provided with a 0.040 in (1.02 mm) longitudinal passageway. The substrate was a 10 mm long porous carbon plug made from Union Carbide's PC-25. It was provided with a 0.029 in. (0.74 mm) drilled longitudinal passageway, and was loaded with 40 mg of a (1:1) mixture of propylene glycol and glycerol. The foil lined tube, as in Example 1, encircled the rear 2 mm of the fuel element and formed the mouthend piece. The article did not have a filter tip, but was overwrapped with conventional cigarette paper. The total length of the article was 80 mm.

Figure 4:
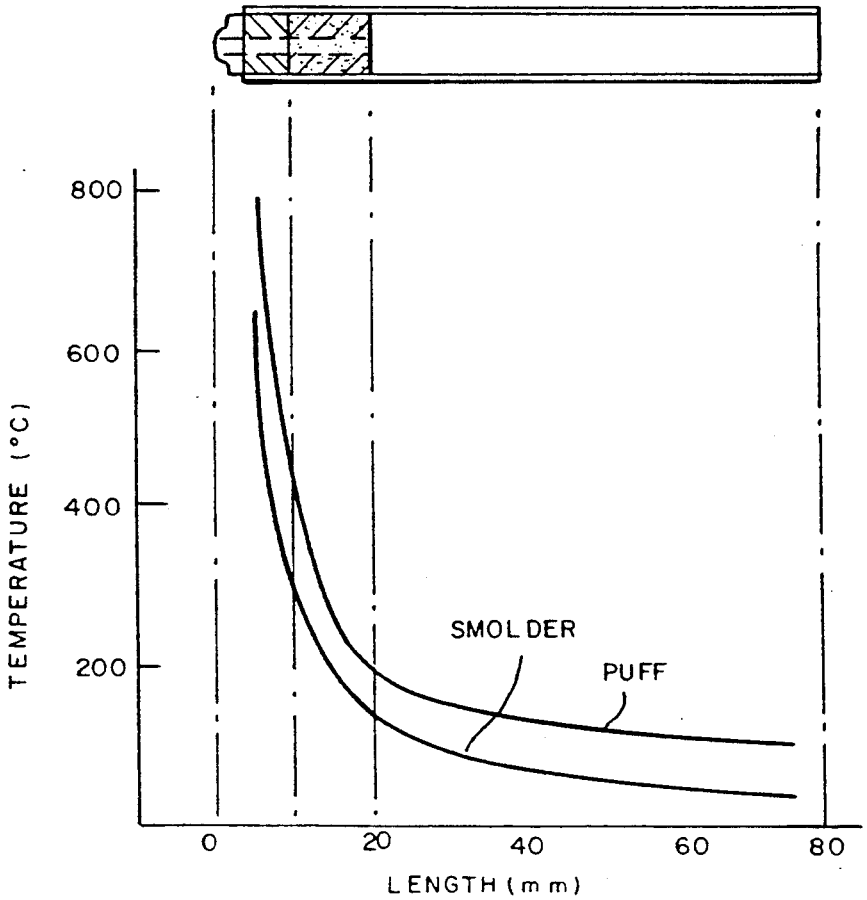
FIG. 4 is the average peak temperature profile of the smoking article of Example 5.

FIG. 4 illustrates the average peak temperatures for this article for both "puff" and "smolder". As shown, the temperature declines steadily between the rear portion of the fuel element and the mouth end of the article.

EXAMPLE 5

A smoking article having the fuel element and substrate configuration of FIG. 3 was made using a 15 mm long annular pressed carbon fuel element with an inner diameter of about 4 mm and an outer diameter of about 8 mm. The fuel element was made from 90% PCB-G activated carbon and 10% SCMC. The substrate was a 10 mm long piece formed from Union Carbide PC-25 carbon with an external diameter of about 4 mm and a longitudinally extending passageway of about 1 mm diameter. The nonparticulate, porous substrate was loaded with 55 mg of a 1:1 glycerin/propylene glycol mixture, and inserted within the end of the fuel element cavity nearest the mouth end. This fuel/substrate combination was inserted 7 mm into a 70 mm long foil lined tube mouthend piece, which was provided with a short (2–4 mm) cellulose acetate filter at the mouth end. The overall length of the article was about 77 mm.

The article delivered substantial amounts of aerosol on the first three puffs, and over the useful life of the fuel element (about 10 puffs).

What is claimed is:

1. A smoking article comprising:

(a) a carbonaceous fuel element less than 30 mm in length prior to smoking; and (b) a physically separate aerosol generating means comprising a porous, nonparticulate substrate bearing an aerosol forming material, said substrate having a longitudinal passageway at least partially therethrough, and the aerosol generating means being longitudinally disposed relative to the fuel element.

2. A smoking article comprising:

(a) a carbonaceous fuel element substantially free of volatile organic material and less than 30 mm in length prior to smoking; and (b) a physically separate aerosol generating means said means comprising a porous, nonparticulate substrate including an aerosol forming material, said substrate having a longitudinal passageway at least partially therethrough; and (c) means for delivering the aerosol produced by the aerosol generating means to the user.

3. A smoking article comprising:

(a) a combustible fuel element less than about 30 mm in length; and (b) a physically separate aerosol generating means comprising a porous, nonparticulate substrate including an aerosol forming material, said substrate having a longitudinal passageway at least partially therethrough, and said substrate being in a conductive heat exchange relationship with said fuel element.

4. The article of claim 3, wherein the fuel element is carbonaceous.

5. The article of claims 1, 2, 3, or 4 wherein the fuel element is less than about 15 mm in length prior to smoking.

6. The article of claim 2, 3, or 4, wherein the substrate includes a plurality of longitudinal passageways.

7. The article of claim 1, 2, 3, or 4, wherein the aerosol generating means comprises a thermally stable material.

8. The article of claim 7, wherein the thermally stable material is carbonaceous.

9. The article of claim 1, 2, 3, or 4, wherein the passageway in the substrate acts as a wicking means.

10. The article of claim 1, 2, or 4, further comprising an insulating surrounding at least a portion of the fuel element.

11. The article of claim 1, 3, or 4, further comprising a heat conducting member which contacts both the fuel element and the substrate.

12. The article of claim 11, further comprising an insulating member surrounding at least a portion of the periphery of the fuel element.

13. The article of claim 1, 3, or 4, further comprising a charge of tobacco between the fuel element and the mouth end of the article.

14. The article of claims 1, 2, 3, or 4, wherein the substrate is less than about 30 mm in length.

15. The article of claim 1, 2, 3, or 4, wherein the article delivers at least about 0.6 mg of wet total particulate matter in the first three puffs under standard FTC smoking conditions.

16. A smoking article comprising:

(a) a combustible fuel element less than about 30 mm prior to smoking in length; and (b) a physically separate aerosol generating means comprising a porous, nonparticulate carbonaceous substrate including an aerosol forming material, said substrate having a longitudinal passageway at least partially therethrough.

17. A smoking article comprising:

(a) a combustible fuel element less than about 30 mm in length prior to smoking;

(b) a physically separate aerosol generating means comprising a porous, nonparticulate substrate including an aerosol forming material, said substrate having a longitudinal passageway at least partially therethrough, and a heat conducting member which contacts both the fuel element and the substrate.

18. The article of claim 17, further comprising an insulating member surrounding at least a portion of the periphery of the fuel element.

19. The article of claim 16, 17 or 18, wherein the fuel element is carbonaceous.

* * * * *

UNITED STATES PATENT AND TRADEMARK OFFICE

CERTIFICATE OF CORRECTION

PATENT NO. : 5,119,834

DATED : June 9, 1992

INVENTOR(S) : Michael D. Shannon et al

It is certified that error appears in the above-indentified patent and that said Letters Patent is hereby corrected as shown below:

Col. 1, line 12, "Put" should be --But--.
Col. 5, line 16, "infrra." should be --infra.--.
Col. 9, line 41, "550°" should be --55°--.
Col. 9, line 48, "suprs," should be --supra,--.
Col. 11, line 13, "294,351" should be --1,294,351--.

In the claims:

Col. 16, line 16, after "insulating" insert --member--.

Signed and Sealed this

Twenty-fourth Day of August, 1993

Bruce Lehman

*Attest:*

BRUCE LEHMAN

*Attesting Officer*

*Commissioner of Patents and Trademarks*